United States Patent [19]

Saito

[11] 4,096,288

[45] Jun. 20, 1978

[54] METHOD OF PARTIAL REPRODUCTION OF A PATTERN FROM A MASTER

[75] Inventor: Hiroshi Saito, Omiya, Japan

[73] Assignee: Kyodo Printing Co., Ltd., Bunkyo, Japan

[21] Appl. No.: 709,729

[22] Filed: Jul. 29, 1976

Related U.S. Application Data

[60] Division of Ser. No. 524,941, Nov. 18, 1974, abandoned, which is a continuation-in-part of Ser. No. 279,808, Aug. 11, 1972, abandoned.

[30] Foreign Application Priority Data

| | | |
|---|---|---|
| Jun. 10, 1972 | Japan | 47-68560[U] |
| Aug. 17, 1971 | Japan | 46-73683[U] |
| Jul. 4, 1972 | Japan | 47-66880 |
| Jul. 4, 1972 | Japan | 47-66881 |

[51] Int. Cl.[2] ..... G03G 13/16

[52] U.S. Cl. ..... 427/24; 96/1.4; 427/121; 428/195; 428/211

[58] Field of Search ..... 427/13, 24, 14, 16, 427/121; 355/3 TR, 3 TE, 7; 96/1.4; 428/195, 211

[56] References Cited

U.S. PATENT DOCUMENTS

| | | | |
|---|---|---|---|
| 2,847,305 | 8/1958 | Walkup | 96/1.4 |
| 3,004,860 | 10/1961 | Gundlach | 96/1.4 |
| 3,483,027 | 12/1969 | Ritzerfeld et al. | 204/143 X |
| 3,783,021 | 1/1974 | York | 427/58 X |
| 3,807,852 | 4/1974 | Hoydic | 355/7 |
| 3,936,172 | 2/1976 | McVeigh | 355/3 R |

*Primary Examiner*—Ronald H. Smith
*Assistant Examiner*—Stuart D. Frenkel
*Attorney, Agent, or Firm*—Wenderoth, Lind & Ponack

[57] ABSTRACT

A method of reproducing in an electrostatic copying apparatus a portion of an entire master pattern comprised of toner deposited on an electrostatic latent image onto a reproducing medium. The reproducing medium, itself, is an insulative sheet material which has a copy surface on which the selected portions will be reproduced. At least one first transparent conductive film is deposited on the back side of the copy surface of the sheet material in the area corresponding to the portion of the master pattern which will not be reproduced, and at least one second transparent conductive film is deposited along only one end of the sheet material on the same side of the material as the first conductor film. Finally, a third transparent conductive film connects the first and second films to each other. The method of producing on this reproducing medium begins by feeding one end of the sheet material opposite the end containing the second conductive film into the electrostatic copier. The copy surface of the insulative sheet material is contacted by the entire toner-coated electrostatic latent image, and the toner is electrostatically transferred to the copying surface of the sheet material in all areas except those corresponding to the conductive film on the back side of the sheet material.

1 Claim, 7 Drawing Figures

METHOD OF PARTIAL REPRODUCTION OF A PATTERN FROM A MASTER

This application is a divisional application of the Applicant's application Ser. No. 524,941, filed Nov. 18, 1974 (now abandoned) which was a continuation-in-part of the Applicant's application Ser. No. 279,808, filed Aug. 11, 1972 (now abandoned).

BACKGROUND OF THE INVENTION

1. Field of the Invention

This invention relates to a method of partial reproduction of a pattern from a master sheet or the like.

2. Description of the Prior Art

Xerography is one of the prior art techniques of image reproduction and comprises (a) preparing an image receiving plate by coating a thin layer of photoconductive material such as selenium on one surface of a plate of electrically conductive material such as aluminum, (b) uniformly charging the photoconductive surface of the image receiving plate with positive electrostatic charges by a corona discharge, (c) projecting an image carried by a master sheet to be reproduced onto the image receiving plate for forming an electrostatic latent image on the photoconductive surface of the image receiving plate, (d) applying a negatively charged toner contained in an insulating liquid or on a dry carrier to the latent image for turning the latent image into a visible image, (e) electrostatically transferring the developed image to a sheet, and (f) heating the sheet to fix the transferred record.

In an attempt to reproduce only specific areas of an image recorded on a master sheet, various methods have been hitherto proposed. According to one of the known methods, a masking sheet suitably cut out at areas corresponding to the desired areas of an image to be reproduced is superposed on the master sheet for the purpose of optically shielding the undesired image portions recorded on the master sheet. According to another known method, a grounded electrode plate suitably cut out at areas corresponding to the desired areas of an image to be reproduced is interposed between a corona discharge electrode and photoconductive surface of the kind above described, and the corona discharge is applied to the photoconductive surface through the cut out grounded electrode plate for partially forming an electrostatic latent image consisting of the desired areas.

However, these prior art methods are defective in that a great deal of inconvenience is encountered in the copying of master sheets and the copying operation cannot be easily carried out due to the fact that the partial reproduction of images on different master sheets requires preparation of a corresponding number of masking sheets or grounded electrode plates cut out to conform to the different patterns and since such sheet or electrode plate must be replaced by another each time the partial reproduction is carried out on a different master sheet.

The known methods above described may be fairly satisfactory when a portion other than a free central portion of the image on the master sheet is partially reproduced. When, however, it is desired to selectively shield only the free central portion of the image on the master sheet and to reproduce the remaining image portions, extreme difficulty is encountered with the prior art methods in the manner of supporting the shielding means because the central portion only of the image on the master sheet must be shielded.

SUMMARY OF THE INVENTION

It is a primary object of the present invention to eliminate all of the above-mentioned prior art defects.

It has been found that such object can be achieved by using a new type of copying sheet in a special manner in reproducing a pattern from an image composed of a toner deposited on an electrostatic latent image produced, in turn, from an original pattern of a master sheet. The entire image is brought into contact with a copying surface of a highly insulative sheet material and the toner is transferred electrostatically to the copying surface. More precisely, the entire image is brought into contact with a particular highly insulative sheet material having no photoconductive layer and which has at least one transparent film deposited on either the copying surface over areas thereof corresponding to areas of the original pattern of the master sheet that are to be blanked out or on the other surface of said sheet material opposite to the copying surface at locations corresponding to the areas of said original pattern to be blanked out, or on both. The film is comprised of an organic conductive compound and has a resistivity of between $10^4$ and $10^7$ ohms, and at least one conductive transparent strip is deposited on at least one end edge of said sheet material on the same side as said at least one transparent film and electrically connected to said at least one transparent film. The sheet material is fed in a direction placing at the end its at least one end edge on which the conductive transparent strip has been deposited.

The entire tone image is composed of a conventional marking material such as dry carbon powder, optionally contained in an insulating liquid or on a dry carrier. Said electrostatic latent image can be produced by conventional xerographic methods on a photoconductive material from an original pattern of a master sheet.

The highly insulative sheet material may be a cellulosic sheet material, preferable a paper sheet.

The at least one transparent film can be deposited either on the copying surface over areas thereof corresponding to areas of the original pattern of the master sheet that are not to be reproduced, or on the other surface opposite to the copying surface at locations corresponding to the areas of said original pattern to be concealed; however, to obtain a smooth copied surface and better appearance, the latter is preferred. The conductive transparent strip(s) should be deposited at least on a feeding end edge of said sheet material, that is, an end edge to be placed at the end of the feeding direction of the sheet material. If a pair of conductive transparent strips are deposited on a pair of opposite end edges the sheet material may be fed in either of two directions, and similarly, if two pairs of the strips are provided the sheet may be fed in any of four directions.

The organic conductive compound itself is known and is, for example, an organic conductive compound selected from the group consisting of alkali metal salt of a styrene-unsaturated dicarboxylic acid copolymer, a sulfonate of oligostyrene or of a oligostyrene-maleic acid anhydride copolymer, a polymer of a piperidine halide salt, a polyvinyl benzyl trimethyl ammonium salt, and a polyisobutyl methacrylate triethyl ammonium salt. So far as being transparent, a mixture of conductive particles, such as silica particles coated with oxides of tin or cadmium, and a vehicle, such as methylmethacrylte in toluene, can also be used as said organic conductive compound.

BRIEF DESCRIPTION OF THE DRAWINGS methylmethacrylate

DESCRIPTION OF THE PREFERRED EMBODIMENTS

Figure 1:
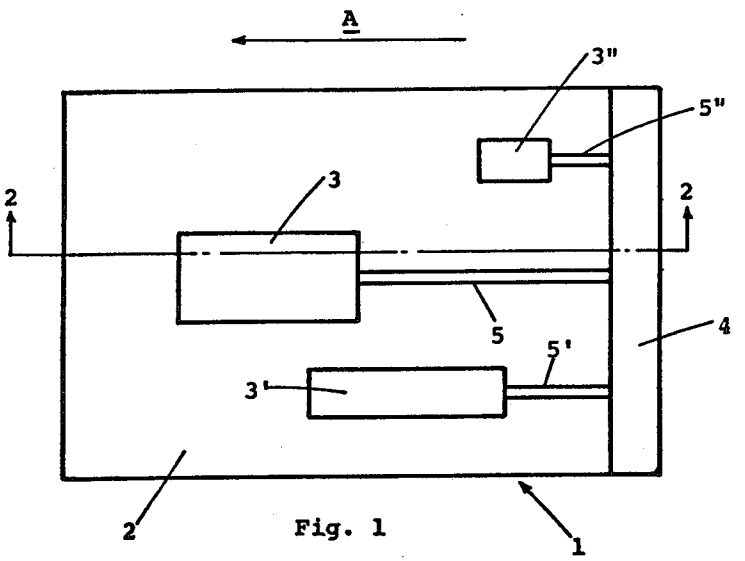
FIG. 1 is a plan view of the copying sheet embodying the present invention.
Figure 2:
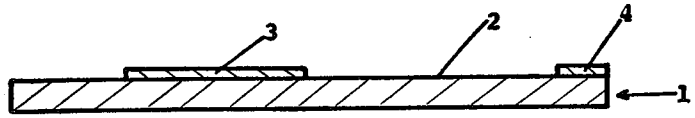
FIG. 2 is a schematic edge view of a copying sheet shown in FIG. 1 along line 2—2 thereof.
Figure 3:
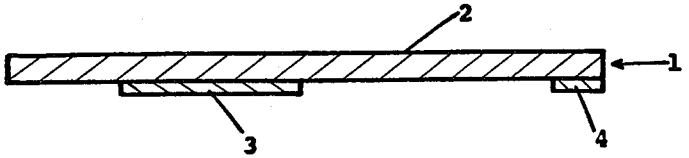
FIG. 3 is a schematic edge view of a further form of the copying sheet embodying the present invention.

Referring to FIGS. 1 and 2, a plurality of conductive transparent films 3, 3' and 3" are deposited on the copying surface 2 of a highly insulative sheet 1, which is preferably a paper of fine quality weighing about 58–116 g/m$^2$, over areas corresponding to areas of the original pattern of the master sheet that are not to be reproduced. The sheet does not have a photoconductive layer. The conductive films may be provided, alternatively, on the opposite surface of the sheet 1 at locations corresponding to the areas of said original pattern to be concealed, as illustrated in FIG. 3. On one end edge of the same side of the sheet as said conductive films, a conductive transparent strip 4 is deposited, and is electrically connected to said conductive films by leads 5, 5' and 5" consisting of, for example, similar conductive transparent strips of narrower width. These sheets, having only one conductive strip on one end edge thereof, should be fed in a direction of the arrow A into a copying apparatus, so as to bring the copying surface of the sheet into contact with the entire toner image, locating at the feeding end this end edge having said conductive strip, and thus to transfer only the desired partial areas of the entire toner image to the copying surface.

The entire toner image is composed of toner deposited on an electrostatic latent image produced from an original pattern of a master sheet. The toner can be a conventional marking material, such as dry carbon powder, optionally contained in an insulating liquid or in a dry carrier. The electrostatic latent image can be produced by a conventional xerographic method on a photoconductive material from the original pattern of the master sheet.

The existence of the conductive strip at least on the feeding end edge of the sheet as well as the conductive films and leads is very critical to obtain a complete shielding of the areas desired to be concealed from the reproduction, while comletely reproducing the other areas. Good concealment and reproduction effects at respective areas cannot satisfactorily be obtained by only the deposition of the conductive films at areas to be concealed (or at locations on the reverse side of the copying sheet corresponding to these areas) since some visible vague images always are reproduced in such cases. Only by using said sheet having the conductive strip at least on one end edge thereof together with the conductive films and leads, placing the end edge at the feeding end, can the intended effects be obtained.

Figure 4:
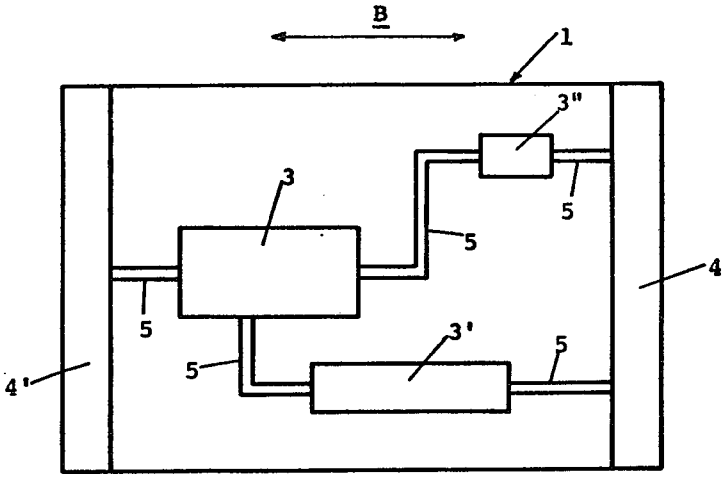
FIGS. 4 and 5 are plan views of yet further forms of the copying sheet embodying the present invention.

As shown in FIG. 4, the conductive strip may be deposited on a pair of opposite end edges as strips 4 and 4'. If all of the conductive films 3, 3' and 3" deposited over the areas to be shielded from the original pattern of the master sheet are electrically connected to both of the strips 4 and 4' by appropriately arranged leads 5, this type of sheet, having a conductive strip on each of two end edges thereof, can be fed in either of the directions of the arrows B in a copying apparatus.

Figure 5:
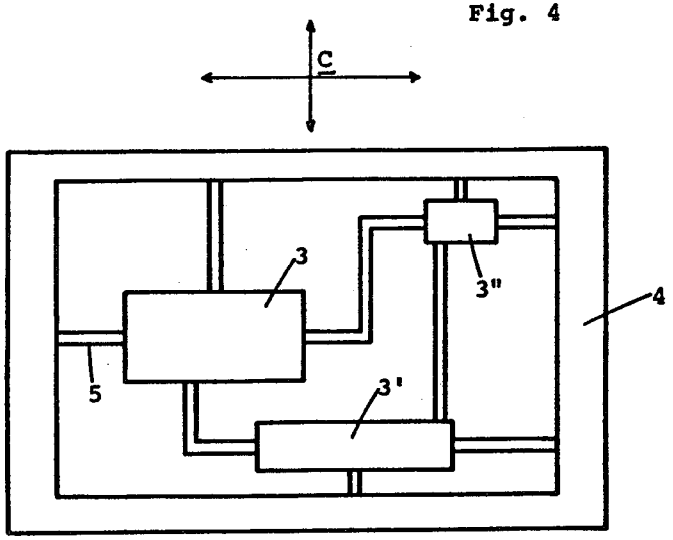

Similarly, a sheet of the type as shown in FIG. 5, having a conductive strip extending along all four end edges can be fed in any of the directions of the arrows C.

The conductive films, strips, and leads are deposited by coating the sheet 1 with a coating solution containing an orgaic conductive compound in a predetermined pattern and then drying the coating. The organic conductive compound is known and may be selected from the group consisting of alkali metal salt of a styrene-unsaturated dicarboxylic acid copolymer, a sulfonate of oligostyrene or of a oligostyrene maleic acid anhydride copolymer, a polymer of a piperidine halide salt, a polyvinyl benzyl trimethyl ammonium salt and polyisobutyl methacrylate triethyl ammonium salt.

The coating solution is prepared by dissolving the organic conductive compound in an appropriate solvent, such as lower alcohol, cellosolve or water, optionally adding an extender such as clay and/or an adhesive such as starch. The amount of the coating solution is such as to leave 1–20 g of solid component per 1 m$^2$ of coated area. The surface resistivity of the films thus deposited should be within the range of $10^4$ – $10^7$ ohms at a relative humidity of 60%. The coating method may be a usual gravure printing method or any other suitable printing method.

Figure 6:
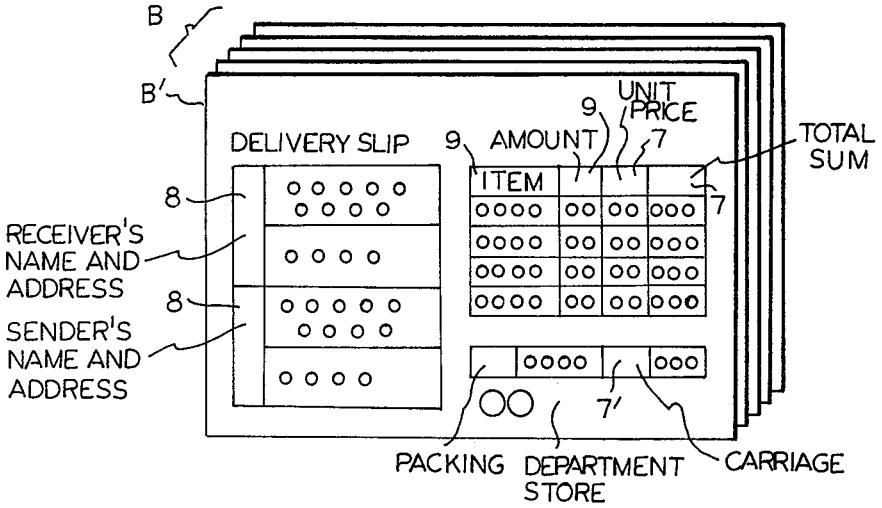
FIG. 6 is a perspective view of a set of slips including a master sheet to be reproduced by the present invention.

Referring to FIG. 6, a set of five to seven delivery slips is generally used in, for example, a department store when an article or articles purchased by a sender are to be forwarded to a receiver. The slip to be forwarded to the receiver is often disposed at the lowermost position of the set, whether by the use of a carbon paper or of a so-called non-carbon paper, mainly for the convenience of processing delivery. Thus, the necessary items to be transcribed to that slip, due to a substantial thickness of the set, tend to be dim, resulting in various inconveniences.

Figure 7:
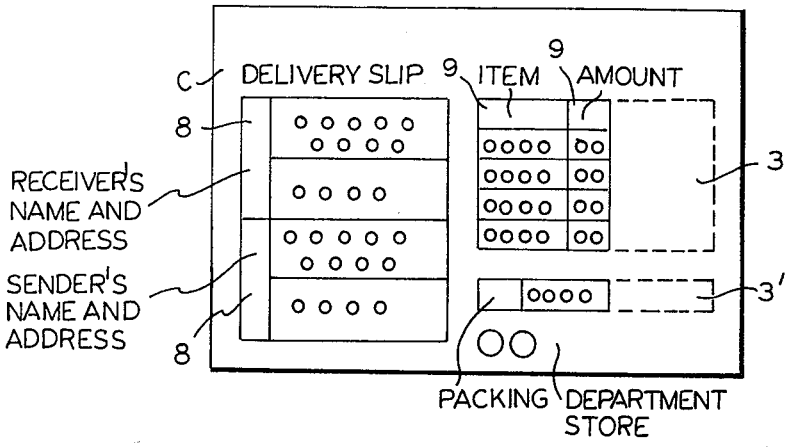
FIG. 7 is a plan view of a partial reproduction of the master sheet shown in FIG. 6.

According to the present invention, a partial reproduction from a master sheet which may be the uppermost slip of the set is made in a manner to obtain a defect-free and clear delivery slip to be forwarded to the receiver of the articles as shown in FIG. 7. Referring to FIG. 7, those items which must be concealed, for example, the unit prices and the total sum 6 and the delivery fee 7 are not copied on the slip to the receiver by virtue of the provision of the conductive films 3 and 3' and the conductive strip 4 electrically connected to the films and also of the direction of feeding this slip into a copying apparatus. Meanwhile, the addresses and names of the sender and receiver 8, the names and quantities of the articles 9, and any other required items are completely copied on the slip C. The conductive films, strip and leads are all transparent and colorless, and the signature of the person in charge of the delivery or any other items may be depicted even on such coatings by a writing utensil such as a ball point pen or a felt pen.

It will be appreciated that the present invention is effective for selectively copying specific portions only of an image carried by a master sheet.

The reason why said good partial concealing and good partial reproducing can simultaneously be obtained only by the present application is not as yet understood. It is all the more surprising if it is considered that such good results cannot be obtained merely by the deposition of the conductive films, as described hereinbefore. In this regard, it is of course to be noted that any grounding means should not make contact with the copying sheet or the highly insulative sheet material, at least during the general steps of bringing the toner image into contact with the copying surface of a highly insulative sheet material and electrostatically tranferring the toner to the copying surface, which are some of the steps of the methods of the present invention, since such grounding of the sheet clearly inhibits the electrostatic transfer of all the toner and make it impossible to reproduce any image from a master.

The following comparative Example substantiates the surprisingly good effects which may only be obtained by the present invention as well as the criticality of using said sheet having the conductive strip at least on one end edge thereof together with the conductive films and leads and placing the end edge at the feeding end.

Comparative Example

(a) Preparation of Coating Solution 75 parts of methanol solution of polyisobutyl methacrylate trimethyl ammonium salt ("KR51S", product of Kyoeisha Oil and Fat Chemical Ind. of Japan; solid content of 27%) are mixed with 15 parts of clay ("Ultra White 90", product of Engelhard Minerals & Chemicals Corp. of New Jersey, USA) and 10 parts of cornstarch ("Nisshoku Corn Starch #3400", product of Nippon Shokuhin Kako Co., Ltd. of Japan). The mixture is then diluted by a solvent mixture (comprising 50% of methanol and 50% of ethyl cellosolve) in a ratio of 9:1. The obtained coating solution shows a viscosity of 19 seconds at 20° C by a Zahn cup No. 4 (having a volume of 40 ml and a nozzle of 4mm in diameter).

(b) Deposition of Conductive Films

A set of 6 delivery slips (for commercial use) (A) to (F) are prepared by printing four identical predetermined patterns (somewhat different for respective sets of 6 slips according to the intended uses thereof) having some blank columns to be filled out by the user, with a brown printing ink, on each slip sheet made of white fine quality paper weighing about 82 g/m$^2$.

The blank columns of the slips (A) to (F) should be filled out with the original data from a master sheet (M) by the xerographic copying method, but columns (*x*) and (*y*) of slips (B) and (D) and columns (*x*), (*y*) and (*z*) of slip (C), should be kept blank to conceal the original contents.

On the reverse side (of the printed surface) of each of the slips (B), (C) and (D), a conductive film or strip is printed with coating solution prepared as described above in section (*a*) by a laboratory gravure printing machine (depth; 60$\mu$, screen: 100 lines/inch) in a form to cover (*i*) the corresponding portions to the columns to be kept blank on the front surface, (ii) the feeding end edge and (iii) the leads running from the portion to the trailing end edge.

The amount of the coating solution is such as to leave 2.3 g of solid component per 1 m$^2$ of coated area. The surface resistivity of the films thus deposited is about 3 $\times$ 10$^6$ ohms at 20° C and at a relative humidity of 60%, which resistivity is determined after 24 hours from deposition according to JIS (Japan Industrial Standards) C2122 using a constant voltage (500V) electric source, an ampere meter and a shielded sample box of "TR-300C", "TR-8651" and "TR-42", each produced by Takenda Riken Co., Ltd. of Japan.

The selective electrostatic copying sheet (slips (B) (C) (D)) thus manufactured is then subjected to the xerographic copying treatment.

(c) Selective electrostatic copying by xerography

The slips (A) to (F) are in turn subjected to xerography, using a common master sheet (M) having the necessary data, and their respective deposited edges "R" are directed backwardly to the feeding direction and the other edges "F" forwardly to the feeding direction (that is to say, letting the deposited edge "R" be a feeding end edge and the other "F" a feeding front edge). As the copying machine, "Xerox 2400B" (product of Fuji Xerox Co., Ltd. of Japan) is used. It should be noted that this machine has no provision for grounding copying sheets as is apparent from the fact that copying sheets of various sizes can be used in the machine to completely reproduce an original.

Another set of slips (A') to (F') is prepared and subjected to the xerographic treatment by the same processes as described in the above (a) to (c), but before subjecting these slips to the xerographic treatment their deposited edges "R" are cut off.

It is observed from these samples of the (A) - (F) series and the (A') - (F') series, (i) [in the (A) - (F) series of the present invention] the columns (*x*) and (*y*) of the slips (B) and (D) and the columns (*x*), (*y*) and (*z*) of the slip (C) are kept completely blank, while other columns of the slips (A) to (F) are filled with fair and complete copies of the contents of the master sheet (M), but (ii) [in the (A') - (F') series without electric conductive film on the feeding end edge] the columns (*x*) and (*y*) of the slip (B') and (D') and the columns (*x*), (*y*) and (*z*) of the slips (C') are not kept blank but have some vague copies of the contents of the master sheet (M), while other columns of the slips (A') to (F') are filled with fair and complete copies similarly to the slips (A) to (F).

It is thus clearly understood from these experiments, that the positioning of an electric conductive film on the feeding end edge of the copying sheet is essential to achieve the complete concealing effect of the present invention.

What is claimed is:

1. A method of reproducing in an electrostatic copying apparatus a portion of an entire master pattern comprised of toner deposited on an electrostatic latent image onto a reproducing medium comprised of:

insulative sheet material having a copying surface on which the selected portions are to be reproduced;

at least one first transparent conductive film deposited on the back side of the copying surface of said sheet material in the area corresponding to the portion of the master pattern which is not to be reproduced;

at least one second transparent conductive film deposited along at least one edge of the sheet material on the same side of the material as said first conductive film; and at least one third transparent conductive film connecting said first and second films to each other; said method comprising;

feeding the end of said sheet material opposite said second conductive film into the electrostatic copier;

contacting the entire toner-coated electrostatic latent image against the copying surface of said insulated sheet material; and electrostatically transferring the toner to the copying surface of the insulative sheet material, whereby the toner does not transfer to the surface of said sheet material corresponding to the position of the conductive film on the backside thereof.

* * * * *